US005597344A

United States Patent [19]

Bocquet

[11] Patent Number: 5,597,344

[45] Date of Patent: Jan. 28, 1997

[54] MACHINE FOR TREATING, IN PARTICULAR SANDING SKI SOLES

[75] Inventor: Jean-Pierre Bocquet, La Motte Servolex, France

[73] Assignee: SKID, La Motte Servolex, France

[21] Appl. No.: 399,741

[22] Filed: Mar. 7, 1995

[30] Foreign Application Priority Data

Mar. 11, 1994 [FR] France ..... 94 03017

[51] Int. Cl.[6] ..... B24B 7/00; B24B 9/00

[52] U.S. Cl. ..... 451/65; 451/67; 156/468

[58] Field of Search ..... 451/65, 300, 305, 451/261, 262, 264, 67; 156/468; 118/72

[56] References Cited

U.S. PATENT DOCUMENTS

| | | | |
|---|---|---|---|
| 3,136,659 | 6/1964 | Walker et al. | 118/72 |
| 4,577,586 | 3/1986 | Morris et al. | 118/72 |
| 4,717,601 | 1/1988 | Bocquet | 118/72 |
| 5,012,758 | 5/1991 | Kunzler | 118/72 |
| 5,052,332 | 10/1991 | Hajek et al. | 118/72 |
| 5,209,780 | 5/1993 | Partel | 118/72 |

FOREIGN PATENT DOCUMENTS

| | | |
|---|---|---|
| 641445 | 12/1934 | Germany . |
| 2209407 | 5/1973 | Germany . |
| 9001959 | 4/1990 | Germany . |
| 254024 | 12/1948 | Switzerland . |

*Primary Examiner*—James G. Smith
*Assistant Examiner*—Derris H. Banks
*Attorney, Agent, or Firm*—Ratner & Prestia

[57] ABSTRACT

A machine for multiple treatment of ski soles includes a plurality of tools on the upper part of a frame and oriented so that their working face is their bottom face. The tools are offset transversely relative to each other. Arrangements for holding and moving the skis hold them with their sliding soles facing upwards and move them under the tools with longitudinal reciprocating movement in translation in the lengthwise directions of the skis, with transverse movement in translation to align the skis selectively with transversely offset tools, and with vertical movement in translation to move the skis selectively into contact with or away from the tools. This machine allows easy selection of the treatments to be applied, whilst significantly improving the quality of work, in particular of grinding or sanding.

12 Claims, 3 Drawing Sheets

MACHINE FOR TREATING, IN PARTICULAR SANDING SKI SOLES

BACKGROUND OF THE INVENTION

1. Field of the Invention

The present invention concerns machines for multiple treatment, especially sanding of ski soles.

2. Description of the Prior Art

Repair and maintenance of ski soles entail multiple treatments which can be combined or carried out separately depending on the required results, and which include:

- resin-coating or partial stopping of the ski sole, carried out dry, rough or finish wet sanding of the ski sole using a strip of abrasive material,
- rough or finish wet grinding the ski sole using a grinding wheel periodically dressed using a diamond tool,
- wet or dry edge grinding generally using a strip of adhesive material, possibly using a diamond grinding wheel,
- dry deburring of the ground edge wires using a very fine abrasive disk or drum,
- waxing the sole, usually carried out dry by applying hot wax or spraying wax paste,
- dry polishing the wax using a non-abrasive polishing disk or drum.

These treatments can be carried out on separate machines each carrying out one kind of treatment, so that seven machines are required in all. For example, document DE-U-90 01 959 describes a ski sole grinding machine with a diamond grinding wheel that is moved longitudinally along a fixed ski; document CH-A-254 024 describes a machine for milling the running groove on the ski sole using a milling tool which is moved longitudinally along a fixed ski; document DE-A-2 209 407 describes a machine for resin-coating the ski sole using a device for recurring the running groove, but with no grinding device, the recurring tool being moved along the fixed ski. These prior art machines require the operator to move along the successive machines in order to pass the ski through them, the ski being driven in one direction only.

Document DE-C-641 445 describes a machine for multiple machining of the top surface of skis using a plurality of fixed cutting tools across which the ski is moved longitudinally with its sole facing downwards. All the machining operations are carried out with the ski travelling at the same speed. The machine does not allow machining or other treatment at different speeds.

With a view to increasing productivity robotized machines have been proposed in which the additional equipment comprises a motorized arm supporting the ski with the sole facing downwards and reciprocating it across the tool. The evolution of such robots has led to designs featuring ever more operations conducted "in line", the workstations being disposed one after the other. The most comprehensive robots can now carry out all the operations mentioned above.

A first drawback of robotized machines is that their in-line design results in a very long machine, each unit being on average 1 m long and wide, to which must be added room for the ski on entering and leaving the machine, i.e. twice 2 m. Accordingly, robots combining the finishing operations, namely grinding, edge grinding, deburring, waxing and wax polishing are about 7 m long by 1.5 m wide. Robots combining all of the operations mentioned above are in the order of 7 m long by 3.5 m wide. The problems of accommodating such machines in the workshops of sporting goods stores which are not designed to accommodate such equipment hardly need emphasizing.

A second drawback is that the in-line design requires that all the units operate with the ski moving forward at the same speed, which is a drawback from the technical point of view: the optimum speed differs from one treatment to another, with the resin-coating speed being around 2 m/min, finish grinding and sanding requiring speeds in the order of 6 m/min to 7 m/min for optimum results, and the other treatments being advantageously carried out at speeds in the order of 4 m/min to 5 m/min. The treatment results are worse if the same speed is used throughout.

A third drawback of robotized machines is a lack of flexibility. Although it is possible to program some only off the treatments previously mentioned, by retracting the unwanted units, the in-line design nevertheless entails the total transit time of the skis through all the stations, making the system less user-friendly.

In prior art robotized machines, the sole of the ski faces downwards and the ski is driven from above. This requires a motorized arm equipped with accessories to support the ski firmly. A first device for this purpose comprises flexible suction shoes which hold the ski from above. Problems can arise with skis which do not have a flat top. If the device accidentally releases the ski it drops onto the workstation which can be very dangerous in the case of a tool with high tangential speed of rotation, in the order of 20 m/s to 25 m/s, for example. A second device includes a mechanism shaped like the sole of a ski boot which fits into the ski bindings and is attached to the motorized arm. A device of this kind cannot be used on skis with no bindings. The ski is also supported irregularly, in particular because of the flexibility of its ends, so that the finish on the soles is less than exemplary.

One problem encountered in prior art machines results from the need for spraying of large amounts of water for wet sanding and grinding. The reason for spraying the water is to prevent the ski sole overheating. The resulting considerable splashing of water, although tolerable in a factory, is not compatible with the necessarily protected environment of a sporting goods store. Being splashed with water is also harmful to some tools of the machine, especially the system for dressing the grinding wheel using a diamond tool, which is usually a high-precision mechanism which must be protected from splashing with water and swarf.

The problem to which the present invention is addressed is that of defining a new architecture for machines for multiple treatment of ski soles which have reduced overall size and reduced cost, offer optimum flexibility in terms of selection of partial treatments, enhance the quality of sanding and other treatments and are very easy to use, especially with regard to handling and fitting the skis.

One aim of the invention is to provide a multiple treatment machine which is compatible with the environment of the repair workshops of sporting goods stores.

SUMMARY OF THE INVENTION

To achieve these and other objectives, a machine for multiple treatment of ski soles, in particular for sanding ski soles, comprises on a frame a plurality of tools each for carrying out one ski sole treatment from the following: resin-coating or stopping of holes or scratches, wet rough or finish belt sanding, wet rough or finish grinding, edge grinding, deburring of ground edge wires, waxing, wax polishing, and including means for holding and displacing the skis and applying their sole to the tools in succession, wherein:

the tools are disposed and oriented so that their working faces are their lower faces, a plurality of tools are offset transversely relative to each other, the means for holding and displacing the skis are adapted to hold the skis with their sliding soles facing upwards and to move them under the tools by reciprocating movement in longitudinal translation in the lengthwise direction of the skis, by transverse movement in translation to move the skis selectively in line with one of the transversely offset tools and in vertical translation to selectively move the skis against or away from the tools.

In one advantageous embodiment of the invention the means for holding and moving the skis comprise:

a carriage mobile transversely on transverse guides of the frame and driven by drive means having control means, a longitudinal beam sliding vertically on vertical guides of the carriage and moved by a jack controlled by said control means, and a box-section open at the top and shaped to receive and retain at least one ski with its sliding sole facing upwards, the box-section being oriented longitudinally and driven longitudinally on the longitudinal beam by longitudinal reciprocating drive means.

In one advantageous embodiment of the invention, whereby the overall size of the machine is considerably reduced when not in use, the longitudinal beam has a center section extending through the frame and to the end of which are articulated respective outer sections which can pivot between a horizontal position aligned with the center section and an upwardly folded position.

The longitudinal beam is advantageously adapted to convey water shed from the ski during treatment into a storage tank in the lower part of the frame.

For the sanding and grinding operations the machine advantageously includes a water sprayer device including spray nozzles mounted on the longitudinal beam connected by a hose to a water pump and disposed opposite one another to spray water onto the area of the ski coming into contact with the sanding or grinding tools.

This machine architecture has the further advantage of exposing the sliding surface of the ski, which faces upwards. The work can therefore be monitored in progress.

Orienting the ski with its sliding surface facing upwards also improves the quality of sanding since the water is advantageously sprayed from either side of the double corner formed between the tool and the ski surface, and is naturally trapped at the exact machining point. Also, the water remains more easily on the sole of the ski and the quantity of water needed to achieve good cooling during sanding or grinding can be reduced.

Also, the tools for dressing the grinding wheel can be disposed externally, above the grinding wheel so that they are naturally protected from splashing with water and swarf.

Because the ski passes under the working units, which are disposed in the upper part of the frame, these units are accessible from above, for example for manual reworking of minor sanding defects or for sanding a snowboard.

Other objects, features and advantages of the present invention will emerge from the following description of specific embodiments of the invention given with reference to the appended drawings.

DETAILED DESCRIPTION OF THE PREFERRED EMBODIMENTS

Figure 1:
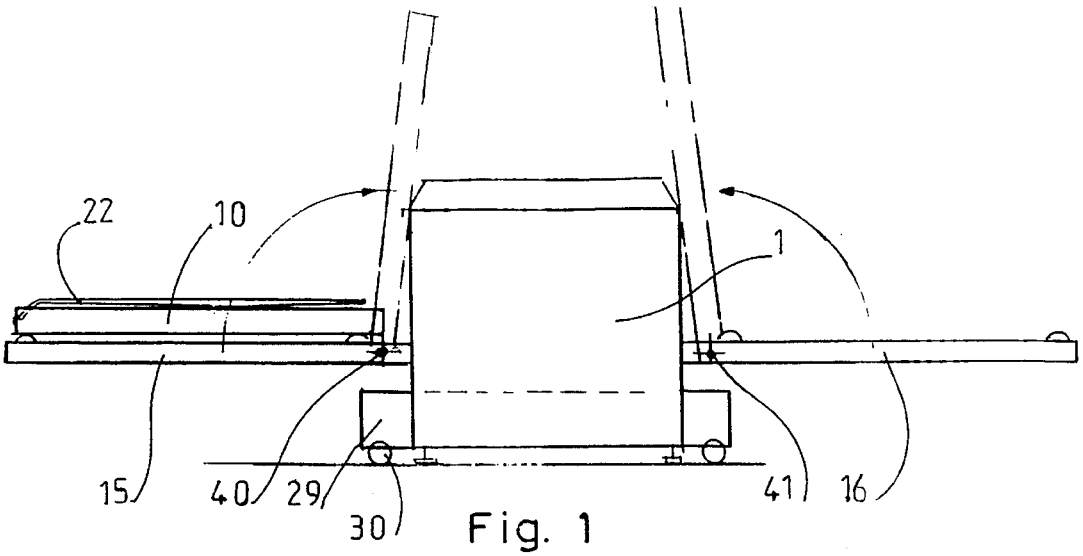
FIG. 1 is a general side view of a machine in accordance with the invention for treating ski soles.

In the embodiment shown in the figures, the frame 1 of the machine includes an abrasive belt sander device comprising drums 2 and 3 around which an abrasive belt 4 runs in the usual way.

The machine also includes a grinding wheel 6 for dressing the sole of the ski, with a system 7 for dressing the grinding wheel using a diamond tool mounted on a transversely mobile motorized carriage. A device 8 for resin-coating the ski sole can advantageously be disposed at the rear of the grinding wheel 6 and protected by a partition 62 to prevent it being splashed with water.

The tools (the abrasive belt 4 and the grinding wheel 6) are in the upper part of the frame 1. In the lower part of the frame 1 is a water storage tank 29 mobile longitudinally on castors 30 and provided with water decantation and filtering systems (not shown).

In the middle part of the frame 1, between the tools and the water tank 29, the machine includes means for holding and moving the skis 22 which press their soles against the successive tools. Accordingly, the normal working face of the tools is the bottom face. The grinding wheel 6 is offset transversely relative to the abrasive belt sander device 4. The means for holding and moving the skis 22 are adapted to hold the skis 22 with their sliding sole facing upwards and to move them under the tools with a reciprocating longitudinal movement in translation in the lengthwise direction of the skis as shown by the arrow 100 in FIG. 2, with a movement in transverse translation as shown by the arrow 101 in FIG. 4 to align the skis 22 selectively with one of the transversely offset tools 4 and 6, and with a vertical movement in translation as shown by the arrow 102 in FIG. 2 to move the skis 22 selectively into contact with or away from the tools.

In the embodiment shown in the figures the means or holding and moving the skis 22 include a carriage 17 moved transversely on transverse guides 18 and 118 on the frame 1 by drive means with associated control means that are not shown in the figures. For example, the carriage 17 has rollers (such as the rollers 20 and 21) rolling on the transverse guides 18 and 118, one of the rollers 21 being driven by the motor-gearbox 23.

A longitudinal beam 14 slides vertically in the direction of vertical translation 102 on vertical guides 24 and 124 of the carriage 17. To this end the carriage 17 has two linear bearings 25 and 125 linked by a longitudinal member 19, the linear bearings 25 and 125 sliding on two vertical guide columns 24 and 124. A jack 126 controlled by said control means moves the beam 14 vertically.

A box-section 10 open at the top is shaped to receive and hold at least one ski 22 with its sliding sole facing up. The box-section 10 is oriented longitudinally and moves longitudinally on the beam 14 as shown by the arrow 100. It is reciprocated longitudinally by drive means.

In the embodiment shown in the figures these reciprocating longitudinal drive means include a notched lower surface 11 of the box-section 10 meshing with at least one notched gear 9 rotating about an axis transverse to the longitudinal beam 14 and driven by a motor-gearbox 12. The box-section 10 rests on idler rollers 13 with transverse axes fixed to the longitudinal beam 14. As an alternative to this, the box-section 10 could slide on any other sliding means such as rails or slideways.

The longitudinal beam 14 advantageously has a center section 114 extending longitudinally through the frame 1 and to the ends of which outer sections 15 and 16 are articulated about respective transverse axes 40 and 41. The outer sections 15 and 16 can pivot between a horizontal position shown in full outline in FIG. 1 in which they are held in alignment with the central section 114 by an end of pivoting movement abutment 37 and a position in which they are folded vertically upwards, as shown in dashed outline in FIG. 1.

The box-section 10 advantageously has water outlets in the bottom for removing water sprayed as part of the wet sanding or grinding treatment. The central section 114 of the longitudinal beam 14 is open at the bottom, between the idler rollers 13, to allow the water to flow out into the water storage tank 29 at the bottom. The outer sections 15 and 16 of the longitudinal beam 14 are closed by longitudinal lateral walls, by transverse front walls and by bottom walls including water outlets connected by respective pipes 38 and 39 to the water storage tank 29 at the bottom.

The machine includes a water sprayer device including spray nozzles 26 and 27 mounted on the longitudinal beam 14, connected by a hose 42 to a water pump 28 fixed to the water storage tank 29 and drawing in water from the storage tank 29 to feed it to the nozzles 26 and 27 which face each other and are adapted to spray water onto the area of the ski in contact with the sanding or grinding tool. The water is therefore sprayed from both sides towards the double corner formed between the tool and the surface of the ski.

All of the capacity of the water pump 28 is concentrated at the mobile nozzles 26 and 27, which limits the pump power required and minimizes unwanted splashing of water. This prevents water from splashing the resin-coating device 8 and, more generally, units which are not in use during each treatment step.

To confine the sprayed water inside the frame 1 the latter includes, on each end transverse wall, two flexible curtains such as the curtains 31 and 32 one end of which is wound onto an automatic spooler such as the respective spoolers 33 and 34. The other end is fixed to a frame 35 fastened to the carriage 17. The frame 35 carries wiper brushes 36 which limit the opening around the longitudinal beam 14 and the box-section 10. Accordingly, the combination of the ski 22 and its support 10 is sprayed with water inside the frame 1 but is advantageously wiped off by the wiper brushes 36 on leaving the machine.

The jack 126 is adapted to move the carriage 17 vertically, in the direction of the arrow 102, and to control the force with which the ski 22 is pressed against the tools. It can be a pneumatic jack producing a force which can be varied between about 100N and about 400N.

The jack is advantageously associated with a safety device which automatically moves the ski 22 away from the tools in the event of accidental interruption of the electrical power supply. All that is needed to achieve this is for the jack 126 to depressurize automatically, the effect of which is to cancel instantaneously contact between the ski 22 and the tools. This very important safety feature is possible only because of the specific architecture of the machine.

Figure 2:
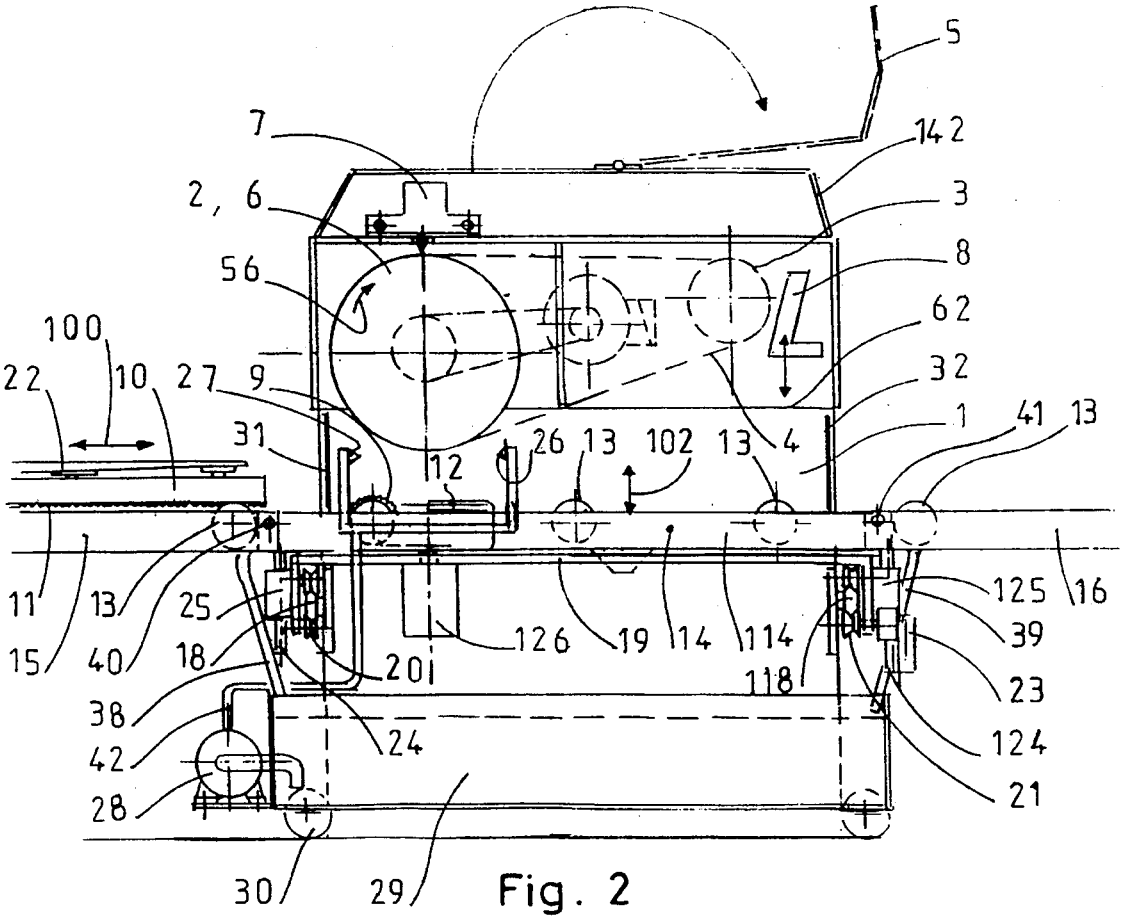
FIG. 2 is a partial diagrammatic side view of the machine from FIG. 1 shown with the side cover removed from the frame of the machine.
Figure 3:
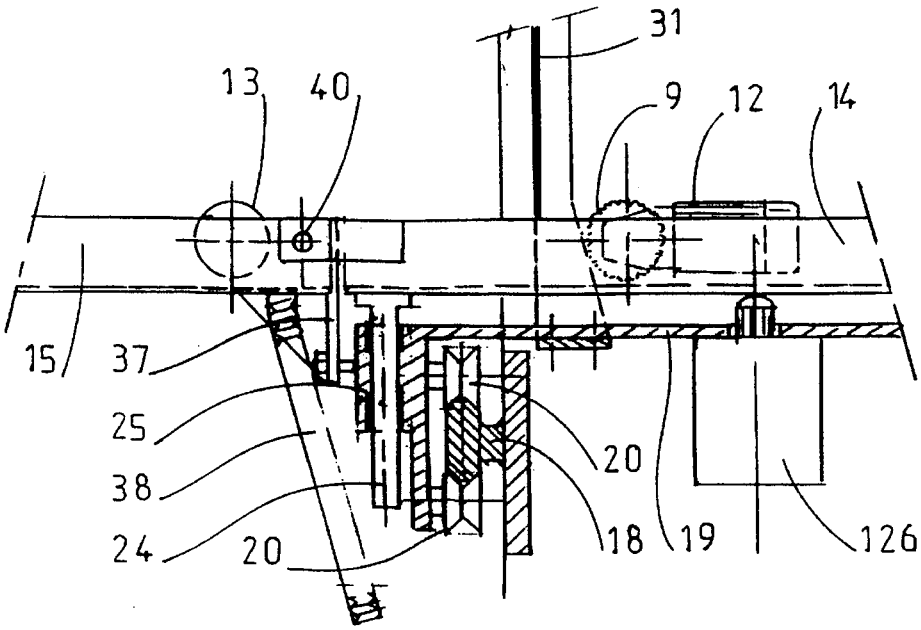
FIG. 3 is a partial side view showing to a larger scale the construction of the transversely mobile carriage and the sliding longitudinal beam.
Figure 4:
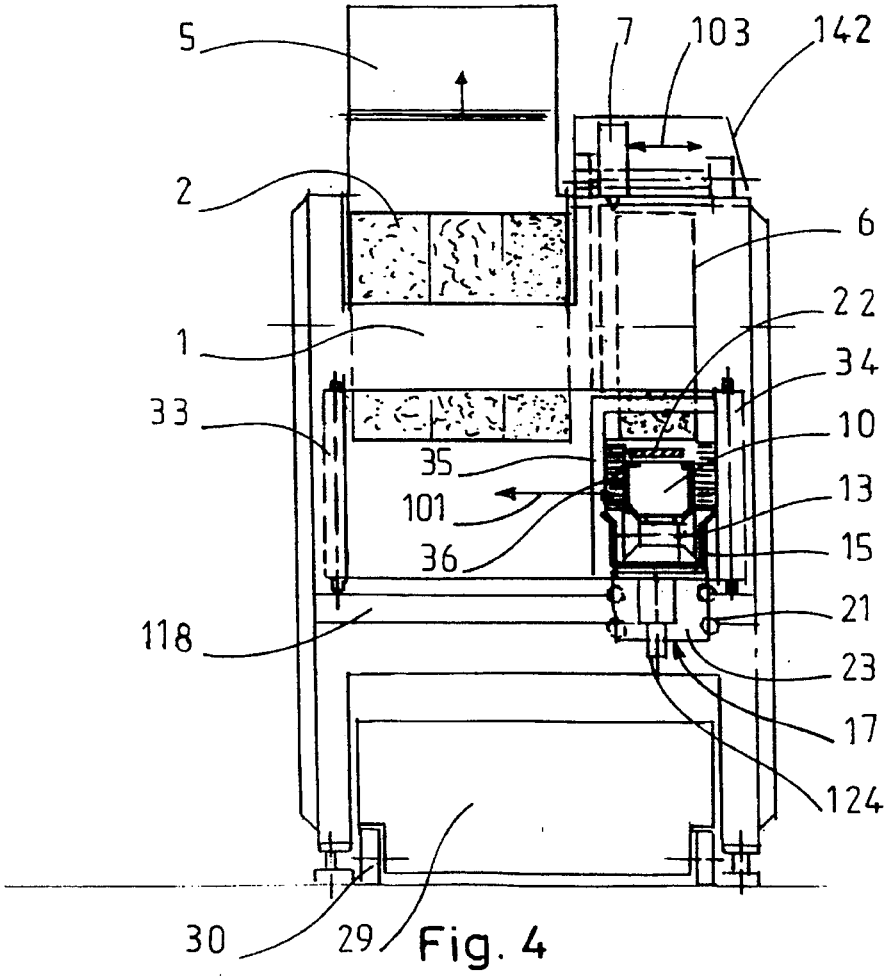
FIG. 4 is a front view of the machine from FIG. 2.
Figure 5:
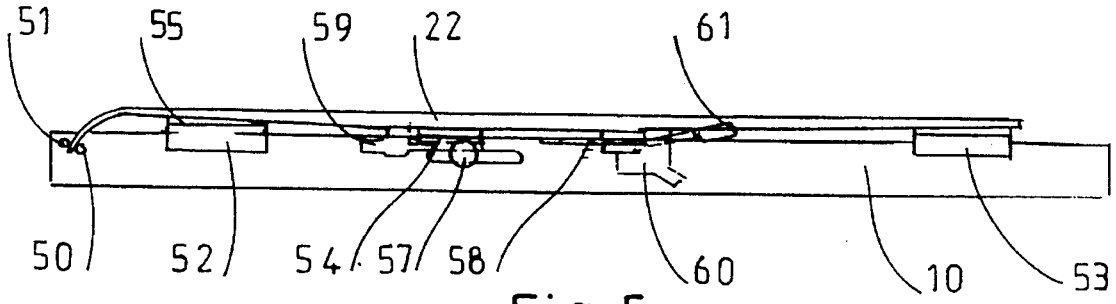
FIG. 5 is a side view of a ski support box-section adapted to be fitted to a machine from FIG. 2.
Figure 6:
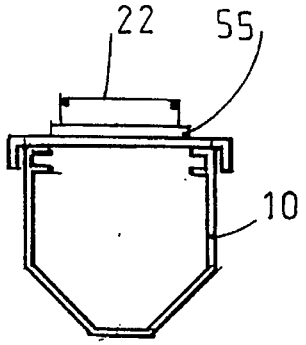
FIG. 6 is a view in transverse section showing the front chock from FIG. 5.
Figure 7:
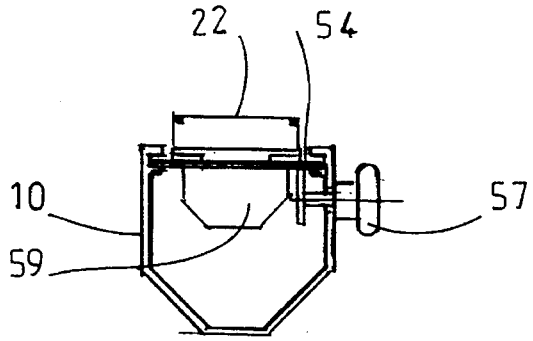
FIG. 7 is a view in transverse section showing the center chock from FIG. 5.
Figure 10:
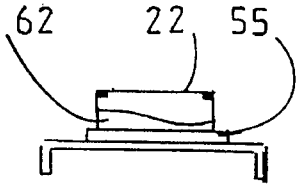
FIG. 10 is a view in transverse section showing a particular conformation from the chocks for a ski in which the upper surface is not flat.

In the embodiment of the invention shown in FIG. 2 and FIG. 4 the machine includes a belt sander device 4 whose upper surface is accessible by removing a retractable top cover 5 of the frame 1, enabling access to the belt 4 for manual sanding.

The machine includes a grinding device with the grinding wheel 6 associated with a grinding wheel dressing device 7 incorporating a diamond tool. The grinding wheel dressing device 7 is mounted on a transversely mobile carriage (arrow 103 in FIG. 4), and is advantageously on the top of the frame 1, above the grinding wheel 6 and therefore protected from splashing with water. The system 7 for dressing the grinding wheel 6 can advantageously be protected by a casing 142. It is naturally protected from splashing with water, which is an important advantage where the maintenance and the longevity of the precision units constituting this mechanism are concerned.

In the embodiment of the invention shown in FIGS. 5 to 10 the box-section 10 is delimited by a bottom wall, by two longitudinal walls whose length is greater than the length of the skis 22, and by two transverse end walls whose length is greater than the width of the skis 22. The top of the box-section 10 is open, and carries means for holding at least one ski 22.

The ski 22 is laid in the box-section 10 with the sliding sole facing upwards. If the ski has bindings, the front binding (toepiece) 59 and the rear binding (heelpiece) 60 are accommodated inside the box-section 10.

In the embodiments shown the means for holding the ski include two spacers 50 and 51 close together near a transverse end wall of the box-section 10 and adapted to allow the insertion and wedging between them of the tip of a ski 22. A central chock 54 slides longitudinally on the upper edges of the longitudinal walls of the box-section 10. If necessary it is held in an adjustable position by locking means such as a transverse clamping screw 57. The center chock 54 is shaped to engage against or under the toepiece 59. Advantageously, it is resiliently urged by a jack towards the spacers 50 and 51 for holding the ski tip, so as to bear at all times against or under the toepiece 59 in the event of any deformation of the ski tip. This holds the ski satisfactorily, even if it has a flexible plastics material tip.

A front chock 52 and a rear chock 53 slide freely in the longitudinal direction on the top edges of the longitudinal walls of the box-section, on either side of the center chock 54.

Figure 8:
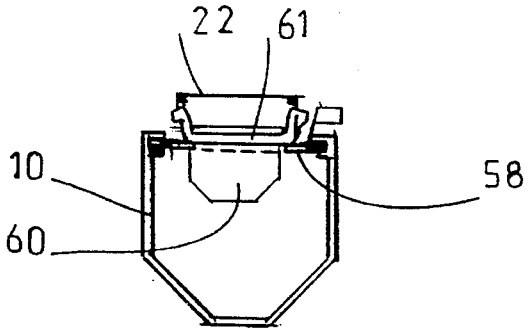
FIG. 8 is a view in transverse section showing an intermediate chock of the box-section from FIG. 5, designed to accommodate the heelpiece (rear binding) and the brake of the ski.
Figure 9:
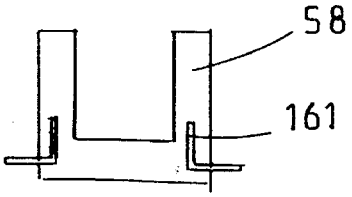
FIG. 9 is a top view of the intermediate chock from FIG. 8.

An intermediate chock 58 also sliding longitudinally on the top edges of the longitudinal walls of the box-section is disposed between the center chock 54 and the rear chock 53. The intermediate chock 58 is adapted to engage between the heelpiece 60 and toepiece 59 and is shaped to retain the ski brake 61 in the retracted position. As shown in FIGS. 8 and 9, to this end the chock 58 locates under the actuator arms 161 of the ski brakes 61.

The chocks 52, 53, 54 and 58 (if present) have a non-skid foam rubber top covering 55 shaped to match the thinning of the ski 22 towards its ends, and possibly to the transverse profile of the top of the ski if this is not flat. For skis whose top is not flat a flexible compensator chock 62 (see FIG. 10) is inserted between the ski 22 and the non-skid foam rubber top covering 55 of the chocks. These compensator chocks 62 are obviously positioned under the corresponding non-flat areas of the ski 22.

There are various ways to locate and wedge the ski 22 in the box-section 10.

If the ski does not have any bindings it necessarily includes a sufficient rigid tip which is wedged between the two spacers 50 and 51. The ski body is then simply rested on the sliding support chocks 52, 53 and 54. The position of the chocks is adjusted to suit the length of the ski 22. The non-skid foam rubber coverings 55 are shaped to match the thinning of the ski and can also be used to compensate for any misalignment between the ski and the successive tools, whilst enhancing the fastening of the ski to its support. Note that the direction in which the tools rotate (see arrow 56 in FIG. 2) tends to push the ski 22 back against the ski tip, so that it is properly immobilized.

When the ski includes bindings, the spacers 50 and 51 holding the ski tip may be of no utility and special means can then be provided for holding the ski even if the tips are very flexible or have been removed. The central chock 54 is positioned under the flanges of the toepiece 59 and is then locked down by the transverse screw 57. The chocks 52 and 53 are unchanged. The intermediate chock 58 can advantageously be added, both retracting the ski brake 61 and making the longitudinal retention of the ski 22 more secure. The intermediate chock 58 does not need to be immobilized by a screw, like the center chock 54, as the action of the ski brakes 61 jams it against its slideways. The intermediate chock 58 is shaped to provide a passage for the heelpiece 60.

Thus the ski 22 can be placed on the beam 10 in total safety, whether fitted with bindings or not and whether complete with its tip or not.

If the tools do not generate any significant longitudinal force, there is no need to immobilize the center chock 54 and no need to fit the intermediate chock 58. This can save time in loading the ski 22.

The device for holding the ski 22, comprising the box-section 10 and its chocks 52, 53, 54 and (when present) 58, can be used independently of the other features of the machine. In particular, it can be used in any other ski treatment machine, for carrying out a single treatment or multiple treatments, and with the ski sole facing upwards or downwards.

When the machine is operating the combination of the box-section 10 and the ski 22, the latter simply resting on the idler rollers 13 and the drive roller 9, is reciprocated longitudinally along the longitudinal beam 14 to move it past the relevant tools. To move it from one tool to the next the longitudinal beam 14 is lowered, the carriage 17 is displaced laterally, and the longitudinal beam 14 is raised to bring the ski 22 into contact with the next tool.

Longitudinal, transverse and vertical displacement are controlled by a control unit (not shown) which is advantageously programmable. In this way each tool is accessible and programmable independently of the others, which authorizes partial and therefore faster treatment. For example, rough sanding followed by finish grinding can be obtained by positioning the ski 22 in front of the preferred area of the rough sanding drum, followed by transverse displacement in front of the grinding wheel 6.

Each operation can be customized and programmed with appropriate settings of the working parameters: the rate of advance can be adjusted from 2 m/min to 8 m/min, depending on the tool in use; the rotation speed of the sanding and grinding tools can be varied: 20 m/s to 25 m/s for rough work, 5 m/s to 10 m/s for finish work. The pressure applied by the jack 126 can also be varied, between about 100N for a finish operation up to about 400N for a rough operation.

The ski sole remains visible at all times during treatment, which can be interrupted prematurely if any machining defect is noted.

The architecture of the machine is much more compact than that of prior art machines and, when folded, the machine of the invention need occupy no more than 1 $m^2$ of floor space, comparable prior art machines taking up five to six times as much room.

The productivity of the machine can be increased by making the beam 14 and the box-section 10 wider, for example, to accept a pair of skis instead of a single ski, and by making the tools wide enough to treat two skis at a time.

The architecture can be either freely reconfigurable or adapted to suit the number of tools to be used. A simple configuration can include a single sanding or grinding tool, for example, thus eliminating all the mechanisms for transverse displacement of the carriage 17. Conversely, further tools can be added, using a wider machine to contain these workstations, for example for edge grinding, polishing, waxing.

The present invention is not limited to the embodiments explicitly described but encompasses variants and generalizations thereof within the scope of the following claims.

There is claimed:

1. Machine for treating ski soles comprising a frame and a plurality of tools, disposed on said frame, for carrying out at least one ski sole treatment and including means for holding and displacing the skis and applying said ski soles to each of said plurality of tools in succession, wherein:

each of said plurality of tools is disposed and oriented so that each of said plurality of tools has a working face which is a lower face, a first of said plurality of tools is offset transversely relative to a second of said plurality of tools, said means for holding and displacing said skis are adapted to hold said skis with said ski soles facing upwards and to move said skis under said plurality of tools by reciprocating movement in longitudinal translation in the lengthwise direction of said skis, by transverse movement in translation to move said skis selectively in line with one of said plurality of tools and in vertical translation to selectively move said skis against and away from said plurality of tools.

2. Machine according to claim 1 wherein said means for holding and displacing said skis include:

a carriage disposed on transverse guides of said frame and driven by drive means having control means, a longitudinal beam for sliding vertically on vertical guides of said carriage and moved by a jack controlled by said control means, and a box-section open at the top and shaped to receive and retain at least one ski with its ski sole facing upwards, said box-section being oriented longitudinally and driven longitudinally on said longitudinal beam by longitudinal reciprocating drive means.

3. Machine according to claim 2 wherein said longitudinal beam has a center section extending through said frame and to the end of which are articulated respective outer sections which can pivot between a horizontal position aligned with said center section and an upwardly folded position.

4. Machine according to claim 3 wherein said box-section has water outlets at the bottom, said center section of said longitudinal beam is open at the bottom, said outer sections are closed by side, front and bottom walls, and said bottom wall includes a water outlet connected by a pipe to a storage tank in a lower part of said frame.

5. Machine according to claim 2 wherein said frame has transverse end walls each having two flexible curtains, each having one end wound on an automatic spooler and a second end fixed to a carriage frame attached to said carriage, said carriage frame carrying wiper brushes limiting the opening around said longitudinal beam and said box-section to confine sprayed water inside said frame.

6. Machine according to claim 2 including a water sprayer device including spray nozzles mounted on said longitudinal beam connected by a hose to a water pump and disposed opposite one another to spray water onto the area of said ski coming into contact with said plurality of tools.

7. Machine according to claim 2 wherein said longitudinal reciprocating drive means of said box-section include a notched lower surface of said box-section meshing with at least one notched wheel rotating about an axis transverse to the longitudinal beam and driven by a motor-gearbox.

8. Machine according to claim 1 wherein said plurality of tools include a sanding device whose upper surface is accessible by removing a retractable top cover of the frame to allow manual sanding.

9. Machine according to claim 1 wherein said plurality of tools include a grinding device with a grinding wheel associated with a diamond tool grinding wheel dressing device mounted on a carriage disposed above the top face of the grinding wheel.

10. Machine according to claim 1 including a safety device which automatically moves said ski away from said plurality of tools in response to accidental interruption of electrical power supply.

11. Machine according to claim 1 wherein said means for holding and moving said skis include a box-section defined by a bottom wall, by two longitudinal walls each having a length greater than the length of said skis, and by two transverse end walls each having a length greater than the width of said skis, and having an open upper side and provided with means for holding at least one ski including:

two spacers close together near one transverse end wall of said box-section and adapted to enable the tip of a ski to be inserted between them, a central chock sliding longitudinally on upper edges of said longitudinal walls of said box-section and held in an adjustable position by locking means urged towards said spacers by a jack, and spaced to engage against or under the toepiece of said ski, a front chock and a rear chock sliding freely in the longitudinal direction on said upper edges of said longitudinal walls of said box-section on either side of said central chock, an intermediate chock sliding longitudinally on said upper edges of said longitudinal walls of said box-section between said central chock and said rear chock, adapted to engage between the heelpiece of said toepiece of said ski and to hold said ski brake in a retracted position, and wherein said chocks include a non-skid foam rubber top covering shaped to match the thinning of said ski towards its end, said ski being merely placed upside down on said chocks with its tip inserted and wedged between said two spacers.

12. Machine according to claim 11 wherein said chocks are matched to a non-plane transverse profile of the top of said ski.

* * * * *